United States Patent [19]
Kitzes et al.
[11] 4,444,680
[45] Apr. 24, 1984

[54] PROCESS AND APPARATUS FOR THE VOLUME REDUCTION OF PWR LIQUID WASTES

[75] Inventors: Arnold S. Kitzes, Pittsburgh, Pa.; Erich W. Tiepel, Littleton, Colo.

[73] Assignee: Westinghouse Electric Corp., Pittsburgh, Pa.

[21] Appl. No.: 277,579

[22] Filed: Jun. 26, 1981

[51] Int. Cl.[3] ..... G21F 9/08
[52] U.S. Cl. ..... 252/632; 159/DIG. 12; 159/23
[58] Field of Search ..... 252/632; 159/DIG. 12, 159/DIG. 13, DIG. 32, DIG. 33, DIG. 16

[56] References Cited

U.S. PATENT DOCUMENTS

| | | | |
|---|---|---|---|
| 2,067,043 | 1/1937 | Caldwell | 159/DIG. 16 |
| 3,137,544 | 6/1964 | Ebner | 159/DIG. 16 |
| 3,191,662 | 6/1965 | Schneider | 252/632 |
| 3,319,400 | 5/1967 | Wilson et al. | 159/DIG. 33 |
| 3,361,649 | 1/1968 | Karter | 252/632 |
| 3,699,007 | 10/1972 | Picek et al. | 159/DIG. 12 |
| 3,893,894 | 7/1975 | Humiston | 159/DIG. 32 |
| 3,933,576 | 1/1976 | Rushton | 252/632 |
| 3,988,414 | 10/1976 | Klicka et al. | 252/632 |
| 3,990,951 | 11/1976 | Rajakovics | 252/632 |
| 4,040,973 | 8/1977 | Szivos et al. | 252/632 |
| 4,139,420 | 2/1979 | Stunkel | 252/632 |

FOREIGN PATENT DOCUMENTS

| | | | |
|---|---|---|---|
| 2165510 | 8/1973 | Fed. Rep. of Germany | 252/632 |
| 1336084 | 1/1962 | France | 159/DIG. 12 |
| 54-144598 | 11/1979 | Japan | 252/632 |
| 55-39251 | 3/1980 | Japan | 159/DIG. 12 |

OTHER PUBLICATIONS

Stickney, W., and T. Fosberg, 1976, Treating Chemical Wastes by Evaporation, Chemical Engineering Progress, Apr. 1976, pp. 41–46.

*Primary Examiner*—Deborah L. Kyle
*Assistant Examiner*—Howard J. Locker
*Attorney, Agent, or Firm*—D. C. Abeles

[57] ABSTRACT

An apparatus for the volume reduction of radioactive liquid waste solutions such as evaporator waste bottoms containing boric acid or sodium sulfate and trace quantities of radioactivity through a vacuum evaporative cooling crystallization process or an evaporative crystallization process. A crystallization unit has an internal baffle which separates the center portion of the unit into a quiescent zone where crystallization can be effected and an inner chamber into which the liquid waste is tangentially introduced. The waste is circulated from the bottom of the crystallization unit through a heat exchanger which adjusts the temperature of the liquid waste and maintains the temperature within a predetermined range. The vacuum draws off a portion of the solvent in the solution. Upon the crystallization of the liquid waste solution to a degree which renders a solid-liquid slurry, the slurry is removed from the apparatus for further treatment.

18 Claims, 4 Drawing Figures

PROCESS AND APPARATUS FOR THE VOLUME REDUCTION OF PWR LIQUID WASTES

BACKGROUND OF THE INVENTION

1. Field of the Invention

The invention is directed to a process and apparatus for the volume reduction of radioactive liquid waste solutions, particularly evaporator waste bottoms containing, for example, either boric acid or sodium sulfate and trace quantities of activity.

2. Description of the Prior Art

Pressurized Water Reactor (PWR) liquid waste streams potentially contaminated by radioactivity are treated in evaporators for the volume reduction of the waste and the reclamation of a clean condensate. The condensates from these evaporators are monitored and recycled after a polishing/demineralization treatment. The evaporator process affords an approximately fifteen to twenty fold volume reduction of the contaminated wastes. Although this is a significant volume reduction, there still remains a substantial quantity of waste evaporator bottoms which must be disposed of.

U.S. Pat. No. 4,119,560 discloses a process of waste volume reduction in which a solution of a liquid solvent and a solid solute is introduced into a hot inert carrier under highly turbulent conditions and at a temperature sufficient to cause the solvent to flash leaving dried dispersed solid particles. In this process, it is then necessary to separate the solid particles from the carrier. Another example of waste treatment is disclosed in U.S. Pat. No. 3,507,801 in which a mixture of radioactive waste water and a sodium borate solution is thickened by heating until the remaining quantity of water is small enough to be bondable by the sodium borate as water of crystallization. The apparatus utilized in such a process can experience scaling and corrosion.

After being subjected to a volume reduction process, the evaporator bottoms are packaged for final disposal. Current disposal methods primarily utilize the technique of mixing or absorbing the waste evaporator bottoms with cement, cement-vermiculite or solidifying with urea-formaldehyde and modified water-extendable polyesters in 55 gallon drums. The packaging method must overcome the problems of leaching and possible escape into the disposal environment.

Both the substantial rate of waste production and the potential regulatory restrictions for current disposal methods have pointed to the need for effective methods of waste volume reduction, packaging and disposal. The present invention is directed to a process and apparatus for the efficient volume reduction of liquid waste containing boric acid or sodium sulfate. Because the product rendered by the instant process is in a solid-liquid slurry form, the waste can be readily mixed with a packaging agent such as cement. As a result, the difficulties previously encountered with leaching are significantly reduced, if not totally eliminated.

It is an object of this invention to provide a process and an apparatus for the volume reduction of low level nuclear waste that precludes waste buildup or wear on mechanical components and that minimizes surface fouling caused by crystal growth.

Another object of this invention is to eliminate crystallizer fouling or freeze-up encountered in other volume reduction systems. The present volume reduction process can operate at an ambient temperature with a low turbulence liquid waste flow.

It is still another object to provide a reduced volume output in a solid-liquid slurry form in which the generation of radioactive dust is eliminated.

These and other objects of the invention will be readily apparent from the description with reference to the accompanying drawings.

SUMMARY OF THE INVENTION

According to the invention, a low level radioactive liquid waste solution from a Pressurized Water Reactor is subjected to a semi-continuous process in which the liquid waste is concentrated by vacuum, evaporative cooling crystallization. The invention also includes an apparatus for the execution of this process.

The crystallization system includes a crystallization unit consisting of a substantially cylindrical vessel with a downwardly projecting, bottom conical portion, an enclosed upper portion and a middle portion with an internal annular baffling means disposed therein defining an open ended cylindrical quiescent zone adjacent the inner wall of the vessel and an inner chamber inside the baffling means. A liquid waste circulation pipe runs downwardly from the apex of the conical portion, through a heat exchanger, and then into the inner chamber of the crystallization unit.

The crystallization system is initially filled with the hot liquid waste solution which is continuously circulated from the conical portion of the crystallization unit through the heat exchanger having a secondary side supplied with cooling water or plant steam and then tangentially discharged into the inner chamber by means of the circulation pump. Vacuum is applied to the crystallization unit by means of a vacuum pump in communication with the upper portion of the vessel. The application of a vacuum to the crystallization unit together with the circulation of the hot liquid waste through the heat exchanger cools the hot liquid waste to a temperature at which crystallization could begin if the solution were saturated. Once the temperature of the initial charge of liquid waste has stabilized, additional hot liquid waste is continuously introduced into the circulation pipe upstream of the evaporator. The additional hot liquid waste provides a thermal input into the crystallization system which is partially relieved in the heat exchanger. The combined liquid waste flow is finally cooled to the crystallization temperature of the solute therein by evaporative cooling in the crystallizer unit. The precipitation and growth of crystals occurs in a controlled manner in the bulk fluid phase. The solvent evaporated to maintain the bulk fluid temperature is condensed and returned to a waste holding tank for further processing. The pH of the liquid waste can be monitored and adjusted, if necessary, to the proper range by the addition of an acid.

The circulation of liquid waste through the system is continued until crystallization reaches a predetermined value, in the range of about 20–30%. Circulation and the introduction of additional hot liquid waste is then stopped and the solids are allowed to settle to the bottom portion of the crystallization unit. The settled solid-liquid slurry is then withdrawn from the crystallization system for proper packaging with an immobilizing agent.

After removing most of the slurry, the crystallization system is again filled to a predetermined level with an initial charge of hot liquid waste and additional makeup feed which is continuously circulated through the system. Any crystals remaining in the crystallizer unit from the previous batch act as nuclei to promote crystal growth.

Depending upon the solute in the liquid waste solution, an alternative process for effecting the volume reduction of evaporator bottoms in the apparatus of this invention is evaporative crystallization. The temperature of the waste liquid circulating through the crystallization unit is maintained above about 90° F. Water is boiled off under vacuum to increase the concentration of the solute above the solubility level to precipitate crystals in the crystallization unit.

DETAILED DESCRIPTION OF THE INVENTION

Liquid waste streams from a pressurized water reactor, potentially contaminated by radioactivity are treated in evaporators for the concentration of waste water constituents; both radioactive and non-radioactive. The condensates from these evaporators are monitored and either recycled or discharged after a polishing/demineralization treatment. This results in a substantial volume of evaporator bottoms. The process and apparatus of this invention will be described treating evaporator bottoms comprising a liquid waste solution containing 12% boric acid ($H_3BO_3$) and trace quantities of activity in detail. This description is not meant to limit the process and apparatus to waste containing boric acid since this invention is equally effective in the volume reduction of sodium sulfate wastes concentrated in the waste evaporators. Moreover, it will be seen that the apparatus of this invention can be utilized in a process for the evaporative crystallization of liquid sodium sulfate wastes.

Figure 1:
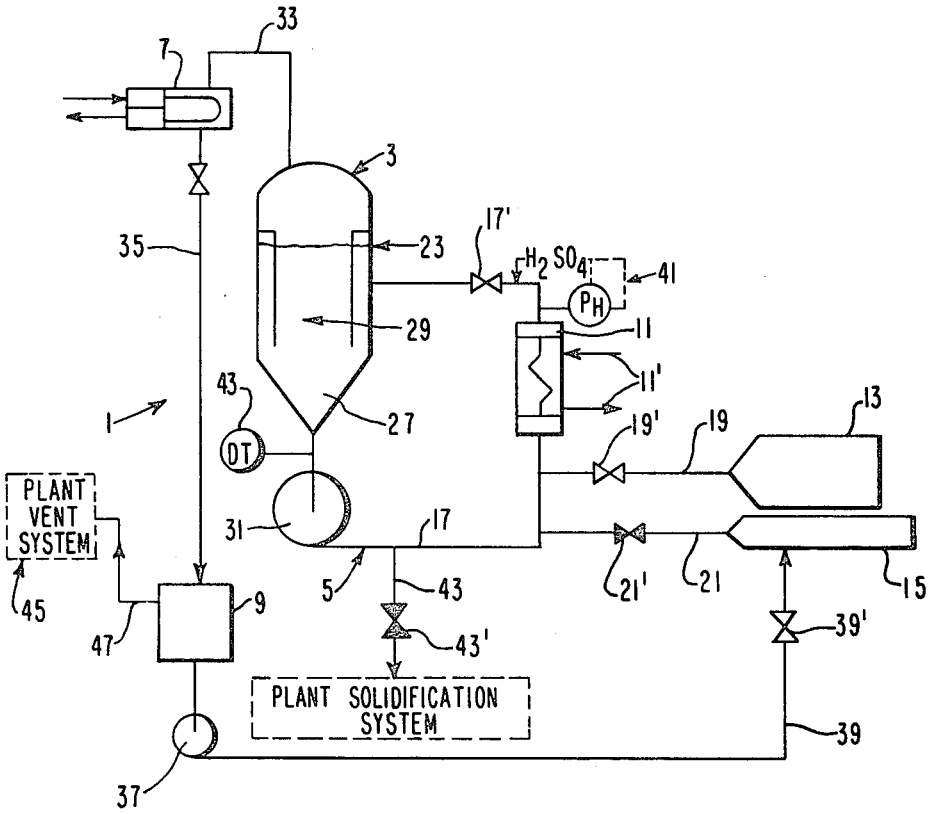
FIG. 1 is a schematic diagram of a system for the volume reduction of radioactive liquid waste according to this invention.

In FIG. 1, a system for the volume reduction of waste evaporator bottoms by a vacuum cooled crystallization process or an evaporative crystallization process is generally indicated by the reference character 1 and includes a crystallization unit 3, a circulation system generally indicated at 5, a condenser 7, a vacuum pump 9 and a heat exchanger 11. The waste reduction system 1 is a semi-continuous batch process in which liquid primarily from the waste evaporator bottoms holdup tank 13 is concentrated by vacuum evaporative cooling crystallization before being packaged for disposal.

Hot waste liquids from the waste holdup tank 13 and/or the floor drain tank 15 enter into the main circulation line 17 of the circulation system 5 through feed lines 19 and 21, respectively. Suitable flow control means such as valves 19[1] and 21[1] are disposed along the lines 19 and 21 to regulate the flow from these tanks into the feed line 17 so that the crystallization unit 3 is filled to a predetermined level as at 23. The hot waste liquid is circulated from the bottom 27 of the crystallizer unit 3 by a circulation pump 31 through main feed line 17 and heat exchanger 11, and is then introduced tangentially into the inner chamber 29 of the crystallization unit 3. Vacuum is applied to the crystallizer unit 3 by the vacuum pump 9 which is in communication with the crystallizer unit 3 by means of vacuum lines 33 and 35 and condenser 7 disposed therebetween. The application of cooling water to the secondary side 11[1] of evaporator 11 together with the vacuum applied to the crystallization unit lowers the hot liquid waste to an ambient temperature of between about 70° to 95° F. Once the temperature of the initial charge of liquid waste is stabilized, additional hot liquid waste is continuously fed into the circulation line 17 from the waste holdup tank 13 upstream of the heat exchanger 11. The additional hot liquid feed maintains the fluid level in the crystallization unit in spite of the solvent loss due to vacuum evaporative cooling. The thermal input of the additional hot evaporator stream is at least partially eased in the heat exchanger 11. The feed circulation stream flows from the heat exchanger 11 through flow control valve 17[1] and tangentially enters the inner chamber 29 of the crystallization unit 3 where the liquid is finally cooled to the temperature at which crystallization can begin by evaporative cooling. The continuous circulation of the cooled liquid waste through the crystallization unit and feed line 17 eliminate crystal fouling or freeze-up in the heat exchanger, the circulating pump or the crystallization unit. Such fouling or freeze-up can occur when a solution becomes supersaturated. When nearly saturated hot solution is slowly cooled, the excess solute remains dissolved and the solution becomes supersaturated. Such solutions are unstable and the solute in the solution which exceeds the saturation level of that solution will tend to crystallize until the concentration level of the solute drops to the point of saturation. As will be more fully explained in the description of the apparatus of this invention, the crystallization unit is provided with a quiescent zone where the crystals can partially settle. The continuous flow of fluid through the pipes inhibits the supersaturated fluid from crystallizing therein and interrupting the processing of the liquid waste.

Figure 2:
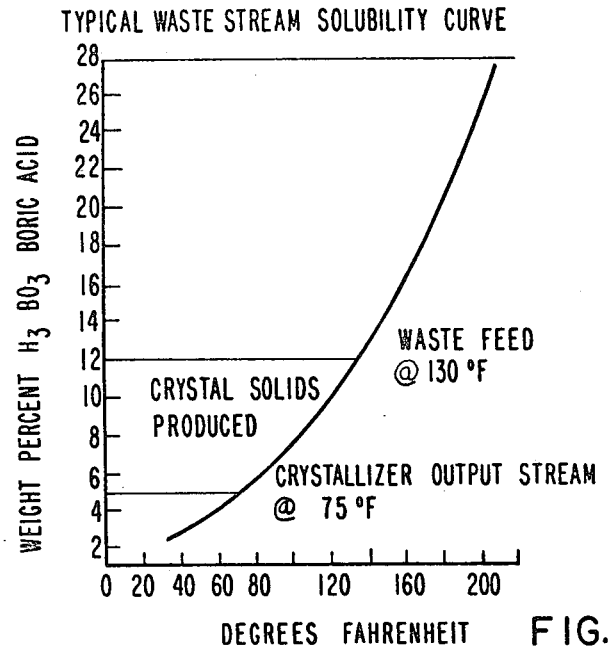
FIG. 2 is a typical boric acid waste stream solubility curve.

As the liquid waste solution is gradually cooled in the crystallization unit 3 through evaporative cooling under vacuum, a small amount of the solvent, approximately 13% of the feed, is evaporated. When the concentration of the waste liquid solute reaches a supersaturated state, crystallization is initiated and proceeds according to the solubility/temperature curve of FIG. 2 as cooling is continued. At ambient temperature, supersaturation is totally relieved and a stable solid-liquid slurry is formed in the crystallization unit. The precipitation and growth of crystals occurs in a controlled manner in the crystallization unit.

The solvent evaporated by the vacuum to maintain bulk fluid temperature, passes through line 33 and into the condenser 7. After condensation, the solvent is returned to a point upstream of the evaporator together with a diluted boric acid solution for reprocessing in the original evaporator, an auxiliary evaporator, ion exchange or through reverse osmosis. Typically, this would be effected by means of a solution return pump 37 which is in communication with the floor drain tank 15 through line 39 and control valve 39[1].

The pH of the liquid waste circulating through the crystallization unit 3 can be monitored and adjusted if necessary, to the proper range by the addition of an acid as at 41, downstream to the heat exchanger 11. Optimally, a low pH in the range of 5 or less is maintained in order to avoid the formation of undesirable compounds during the crystallization process.

The waste liquid is continuously circulated from the bottom 27 of the crystallization unit 3 back into the inner chamber thereof through line 17 until the concentration of crystals reaches a predetermined value of approximately 20–30% and preferably 25%. The concentration can be monitored by a density transmitter 43 proximate the bottom of the crystallizer unit. The operation of the crystallization unit and the crystallization process as it occurs therein will be more fully explained below. When the predetermined density is achieved, circulation of the fluid within the crystallization system is stopped and the solids are allowed to settle in the bottom portion of the crystallizer. The settled crystalline slurry is then removed via pump 31 through discharged line 43 and discharge control valve $43^1$ for packaging with a suitable immobilizing agent.

After the removal of a substantial portion of the crystallized solids in the crystallization unit 3, the treatment of a new batch of hot liquid waste can begin. Any crystals remaining in the crystallization unit 3 act as nuclei which promote crystal growth in the next batch of waste liquid treated. An initial charge of hot liquid waste fills the crystallization unit to a predetermined level and the volume reduction process can begin once again.

Any noncondensible gases that might be produced in the crystallization process are also drawn off by the vacuum pump 9 and transferred to the plant vent system 45 through line 47.

The vacuum cooled crystallization process described above for the volume reduction of liquid waste evaporator bottoms containing about 12% solids boric acid may also be used for the volume reduction of liquid waste evaporator bottoms containing about 20% solids sodium sulfate. Through evaporative cooling crystallization, the sodium sulfate can be recovered as either sodium sulfate decahydrate or as sodium sulfate by the addition of a secondary salt such as sodium chloride to reduce the sodium sulfate solubility.

Figure 3:
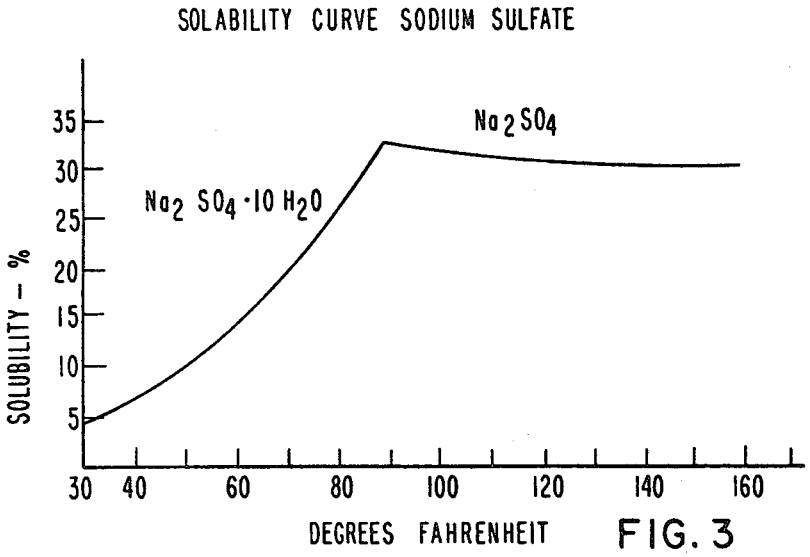
FIG. 3 is a typical sodium sulfate waste stream solubility curve.

The preferred method of sodium sulfate removal is an evaporative crystallization process which can be readily effected by the apparatus of this invention. The sodium sulfate ($Na_2SO_4$) solubility curve illustrated in FIG. 3 shows that solubility increases as the temperature approaches 90° F. Below about 90° F., sodium sulfate decahydrate is recovered. This compound contains 57.5% water by weight and obviously possesses the disadvantageous characteristic of having a greater weight in water than in the sodium sulfate removed for disposal.

In order to utilize the apparatus of this invention is an evaporative crystallization mode, the liquid waste solution is maintained at a temperature above 90° F. during circulation through the crystallization unit. The temperature is preferably in the range of 110° to 120° F. to conserve energy and essentially boil off water under the vacuum in order to increase the sodium sulfate concentration above the solubility level.

The boil off rate and the circulation rate are controlled so that the crystals can settle in the crystallization unit rather than accumulate at the liquid vapor interface. In order to maintain the desired temperature during the evaporative crystallization mode, steam is supplied to the secondary side $11^1$ of the heat exchanger 11. Once the sodium sulfate concentration is above the solubility level, precipitation and crystal growth occur as described in the evaporative cooling crystallization mode.

Figure 4:
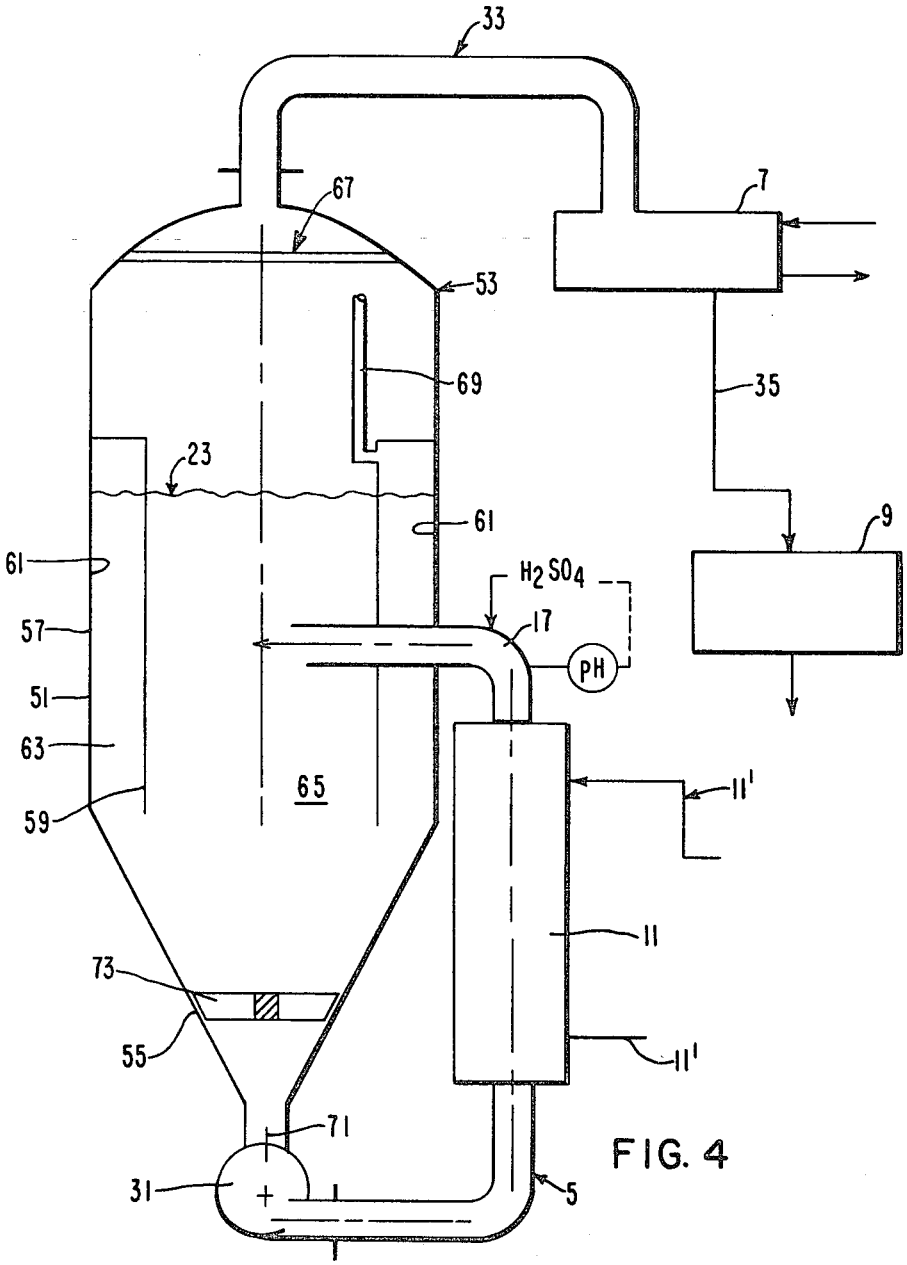
FIG. 4 is a schematic illustration of a crystallizer unit utilized by this invention.

Turning now to FIG. 4, it can be seen that the crystallization unit 3 includes a vertically disposed substantially cylindrical vessel 51, having an upper liquid-vapor interface portion 53, a lower conical portion 55 and a middle body portion 57 therebetween. An internal annular baffling means 59 is circumferentially disposed in a spaced relation with the inner wall 61 at the middle portion 57 of the crystallizer unit 3. The baffling means 59 defines an annular quiescent zone 63 where crystallization begins between the baffling means 59 and the inner vessel wall 61, and an inner chamber 65 within the baffling means 59. Feed pipe 17 passes through the quiescent zone 63 and is so situated in the inner chamber 65 that the liquid waste flow circulating through the feed pipe 17 re-enters the inner chamber 65 tangentially to the baffling means and at a point about one and one-half feet below the top of the baffling means 59. The re-entry of the liquid waste flow well below the liquid vapor interface 23, prevents the disturbance of the interface.

The upper liquid-vapor interface portion 53 has a demister 67 which traps drops of solvent and other matter within the liquid waste solution which might become entrained by the vacuum induced vapor flow through line 33. The annular quiescent zone 63 is in communication with the upper portion 53 by vent means as at 69 in order to equalize the pressure in the two zones. Preferably, the liquid-vapor interface 23 is at a level below the top of the baffling means 59.

The lower conical portion 55 of the crystallization unit has an egress means 71 at the apex thereof through which first the liquid waste and, later when the desired density of the flow is achieved the solid-liquid slurry are discharged. A swirl breaker 73 is installed in the lower reaches of the conical portion of the vessel. The swirl breaker 73 together with the tangential entry of the liquid waste into the inner chamber of the crystallization unit minimize the turbulence of the liquid waste within the crystallization unit. While not illustrated, it should be pointed out that the crystallization unit 3 can be skid mounted for plant installation and appropriately shielded and arranged for ready maintainability and ease in effecting decontamination procedures with minimum personnel exposure.

The circulating pump 31 should allow for a mixed rather than classified product circulation and should generate a waste flow velocity of between about 5 to 7 feet per second. The heat exchanger 11 is preferably a straight tube heat exchanger in line with the circulation system. The maximum change in temperature in the heat exchanger should not exceed about 25 degrees and the maximum cooling and heating of the combined feed-circulation flow should be limited to 3° to 5° F. The secondary side $11^1$ of the heat exchanger may be provided with either cooling water or plant steam as necessary in order to ensure that the proper temperature of the liquid waste flow is maintained.

Approximately five hundred gallons of a 12% boric acid solution from the waste evaporator can be processed at a rate of two to three gallons per minute in about four hours to yield a slurry dischare of about 65–70 percent solids by weight. A volume reduction factor of about 6:1 is achieved. This slurry concentration is equivalent to a crystal concentration of approximately 25 percent in the bulk fluid. The fluid returned to the system after condensation will contain approximately 5 to 6% boric acid in solution. As previously indicated, sodium sulfate wastes can also be treated in the process of this invention. For sodium sulfate wastes, concentrated to about 20 to 25 percent in the waste evaporator, the crystallization process will produce a 60 percent solid by weight sodium sulfate slurry. An approximate 3:1 volume reduction is achieved.

It should finally be noted that if for any reason it should become necessary to flush the crystallization system, plant steam can be injected into the secondary side of the heat exchanger 11 in order to heat the fluid stream in the system. The heated stream could then dissolve any undesired crystalline buildup in the system. The heated stream could then be cooled and processed according to this invention.

We claim:

1. A process for the volume reduction of a hot radioactive liquid waste solution containing a solute selected from the group consisting of boric acid and sodium sulfate in a crystallization unit comprising a cylindrical vessel with a bottom conical portion and a cylindrical baffle spaced from the wall of the intermediate portion of the vessel, said process comprising the steps of:

adjusting the temperature of an initial charge of the hot solution to within a few degrees of saturation by passing it through a heat exchanger;

introducing said initial charge of solution into said cylindrical vessel to fill said vessel to a predetermined level within the range of said baffle;

applying a vacuum to said solution in said vessel to evaporatively cool it to at least the saturation temperature;

circulating said solution from the bottom of the vessel through the heat exchanger and reintroducing it into said vessel tangentially to the inner surface of the cylindrical baffle below said predetermined level;

introducing additional hot solution upstream of the heat exchanger to adjust the temperature thereof to within a few degrees of saturation and to maintain said predetermined level of solution in said vessel;

adjusting the rate of evaporation and circulation such that a quiescent zone is formed between said baffle and the vessel wall and so that as the solution becomes saturated crystals form in the quiescent zone and fall toward the conical bottom of the vessel rather than accumulating at the liquid vapor interface;

terminating circulation of said solution through the heat exchanger when the concentration of crystals reaches a predetermined value and allowing the crystals to fall to the conical bottom of the vessel to form there a crystalline slurry; and removing the crystalline slurry from the conical bottom of the vessel.

2. The process according to claim 1 wherein the predetermined level of concentration of crystals within the crystallization unit is between approximately 20 to 30% by volume.

3. The process according to claim 2 wherein the predetermined level of concentration of crystals within the crystallization unit is approximately 25% by volume.

4. The method of claim 1 wherein the hot liquid waste solution is a sodium sulfate solution and wherein the temperature of the sodium sulfate is maintained at a temperature above 90° F.

5. The process according to claim 4 wherein the temperature of the liquid sodium sulfate waste is maintained at a temperature between about 110° and 120° F.

6. The process according to claim 1 including the steps of monitoring the pH of the liquid boric acid waste solution during its circulation through the pipe and adjusting the pH to maintain the conditions for crystal formation.

7. The process according to claim 6 wherein the pH of the solution is maintained at a level of about no greater than 5 for boric acid waste.

8. The process according to claim 1 including the step of condensing the vapor drawn off of the solution by the application of the vacuum.

9. The process according to claim 8 including the step of returning the condensed vapor to the solution circulating through said crystallization unit.

10. An apparatus for the volume reduction of a hot radioactive liquid waste solution containing a solute selected from the group consisting of boric acid and sodium sulfate by separating said waste solution into vapor and solid-liquid slurry constituents by crystallization comprising:

a vertically disposed substantially cylindrical vessel having an inner surface, an enclosed upper liquid-vapor interface portion having egress means therein for the withdrawal of the vapor from said upper portion, a lower conical portion having egress means at the apex thereof for the discharge of the liquid waste and the slurry from said vessel and a middle body portion therebetween;

a continuous annular baffling means circumferentially disposed in a spaced relation to the inner wall of said vessel within said middle body portion and defining a quiescent zone between said baffling means and said inner surface of said vessel at said middle body portion and an inner chamber within said baffling means;

pipe means for the introduction of said liquid waste into said inner chamber tangentially relative to said baffling means and for the circulation of said liquid waste from the egress of the conical portion to the inner chamber;

pump means for the circulation of fluid through said pipe and said substantially cylindrical vessel;

heat exchanger means in communication with said pipe to adjust the temperature of said hot liquid waste to about the temperature of crystallization thereof; and vacuum means in communication with the vapor egress means in the enclosed upper portion to effect the withdrawal of the vapor from the liquid waste, whereby said vacuum means reduces the amount of solvent in said solution so that said liquid solution is driven into supersaturation within the crystallization unit quiescent zone, the circulation of fluid through said crystallization unit and said pipe inhibiting undesirable crystal formation in the heat exchanger, pump and pipe and a solid-liquid slurry is produced.

11. The apparatus according to claim 10 wherein the upper liquid-vapor interface portions includes a demister through which the vapor withdrawn from the upper portion passes.

12. The apparatus according to claim 11 wherein the lower conical portion includes a swirl breaker mounted therein to control any turbulence of the solution therein.

13. The apparatus of claim 10 including means for monitoring and means for adjusting the pH of the solution entering the inner chamber of the vessel.

14. The apparatus of claim 12 including condenser means in communication with the vapor egress means for the cooling and condensation of at least a portion of the vapors drawn from said egress means.

15. The apparatus of claim 13 including waste hold up tank means in communication with the pipe means and upstream of the heat exchanger means for the controlled introduction of hot liquid waste into said pipe.

16. An apparatus for the volume reduction of a hot radioactive liquid waste solution containing a solute from the group consisting of boric acid and sodium sulfate by separating said waste solution into vapor and solid-liquid slurry constituents by vacuum cooled crystallization comprising:

a vertically disposed substantially cylindrical vessel having an inner surface, an enclosed upper liquid-vapor interface portion having egress means therein for the withdrawal of the vapor from said upper portion, a lower conical portion having egress means at the apex thereof for the discharge of the liquid waste and the slurry from said vessel and a middle body portion therebetween;

a continuous annular baffling means having an upper edge, said baffling means being circumferentially disposed in a spaced relation to the inner wall of said vessel within said middle body portion and defining a quiescent zone between said baffling means and said inner surface of said vessel at said middle body portion and an inner chamber within said baffling means; and pipe means for the introduction of said liquid waste into said inner chamber below the upper edge of and tangentially to the baffle means, said pipe means being in communication with said egress mean at the apex thereof and through which the liquid waste flows;

whereby the hot liquid waste solution is cooled to its crystallization temperature and supersaturation of the solution is achieved by vacuum cooling of said solution.

17. The apparatus according to claim 16 wherein the upper liquid-vapor interface portion includes a demister through which the vapor withdrawn from the upper portion passes.

18. The apparatus according to claim 17 wherein the lower conical portion includes a swirl breaker mounted therein to control any turbulence of the solution within the vessel.

* * * * *